US009681740B2

(12) United States Patent
Lee

(10) Patent No.: US 9,681,740 B2
(45) Date of Patent: Jun. 20, 2017

(54) ORAL CARE IMPLEMENT

(71) Applicant: COLGATE-PALMOLIVE COMPANY, New York, NY (US)

(72) Inventor: David K. Lee, East Brunswick, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 77 days.

(21) Appl. No.: 14/650,814

(22) PCT Filed: Dec. 10, 2012

(86) PCT No.: PCT/US2012/068685

§ 371 (c)(1),
(2) Date: Jun. 9, 2015

(87) PCT Pub. No.: WO2014/092674

PCT Pub. Date: Jun. 19, 2014

(65) Prior Publication Data

US 2015/0320192 A1 Nov. 12, 2015

(51) Int. Cl.
*A46B 5/00* (2006.01)
*A46B 15/00* (2006.01)

(52) U.S. Cl.
CPC ..... *A46B 5/0029* (2013.01); *A46B 15/0081* (2013.01); *A46B 2200/1066* (2013.01)

(58) Field of Classification Search
CPC ..... A46B 5/0029; A46B 15/0081; A46B 2200/1066
See application file for complete search history.

(56) References Cited

U.S. PATENT DOCUMENTS

| | | | |
|---|---|---|---|
| 1,125,532 | A | 1/1915 | Himmel |
| 5,355,546 | A | 10/1994 | Scheier et al. |
| 5,651,158 | A | 7/1997 | Halm |
| 5,839,149 | A | 11/1998 | Scheier et al. |
| 6,290,302 | B1 | 9/2001 | Boucherie |
| 2010/0263148 | A1 | 10/2010 | Jimenez et al. |
| 2011/0152909 | A1 | 6/2011 | Jimenez et al. |

FOREIGN PATENT DOCUMENTS

| | | |
|---|---|---|
| CN | 200983953 | 12/2007 |
| CN | 101115418 | 1/2008 |
| CN | 102726938 | 10/2012 |
| CN | 102783810 | 11/2012 |
| DE | 102 21 786 | 11/2003 |
| DE | 20 2011 109 451 | 3/2012 |

(Continued)

OTHER PUBLICATIONS

Corresponding Chinese Office Acton issued on Mar. 28, 2018.

(Continued)

*Primary Examiner* — Shay Karls

(57) ABSTRACT

Disclosed is an oral care implement comprising: a body having a head portion having a front side and a rear side, at least one cleaning element disposed at the front side of the head portion of the body, and a rim extending from the rear side of the head portion of the body, wherein the rim includes one or more weakened portions and extends along a perimeter region of the head portion of the body; and resilient material disposed at the rear side of the head portion of the body, wherein the rim is disposed around at least a portion of the resilient material.

24 Claims, 3 Drawing Sheets

(56) References Cited

FOREIGN PATENT DOCUMENTS

| | | |
|---|---|---|
| DE | 20 2012 002 332 | 5/2012 |
| EP | 2 078 472 | 2/2010 |
| EP | 2 377 425 | 10/2011 |
| GB | 673516 | 6/1952 |
| WO | WO 00/03619 | 1/2000 |
| WO | WO 2011/070550 | 6/2011 |
| WO | WO2011109626 | 9/2011 |
| WO | WO 2011/127951 | 10/2011 |

OTHER PUBLICATIONS

International Search Report and the Written Opinion of the International Searching Authority issued in International Patent Application PCT/US2012/068685 mailed Sep. 5, 2013.

Written Opinion of the International Preliminary Examining Authority issued in International Patent Application PCT/US2012/068685 mailed Feb. 19, 2015.

ORAL CARE IMPLEMENT

CROSS-REFERENCE TO RELATED PATENT APPLICATIONS

This application is a U.S. national stage application under 35 U.S.C. §371 of PCT Application No. PCT/US2012/068685, filed Dec. 10, 2012, the entirety of which is incorporated herein by reference.

BACKGROUND OF THE INVENTION

Oral care implements, especially toothbrushes, are used by many people on a daily basis. Typical oral care implements comprise an elongate handle and a head connected to one end of the handle. The handle provides a structure by which a user grips and manipulates the oral care implement during use. The head typically comprises one or more elements designed to perform their intended function, such as tooth cleaning elements, soft tissue cleaning elements, and/or oral care agents.

Toothbrushes are oral care implements having one or more tooth cleaning elements, which are used to clean teeth by removing plaque and debris from surfaces of the teeth. Soft tissue cleaners, such as tongue scrapers, are oral care implements having one or more soft tissue cleaning elements, such as blades or surfaces with a multiplicity of protrusions extending therefrom, which are used to clean soft tissues in a user's mouth by reaching into crevices and folds in soft tissue, such as the papillae on the user's tongue, where bacteria and microdebris have collected.

Conventional oral care implements are limited in their ability to comply with oral surfaces during an oral care session. For example, during an oral care session, tooth cleaning elements of conventional toothbrushes are able to contact only some of the total surface area of a user's teeth. They might not be able to reach into the spaces between teeth at all. As a result, some portions of the total surface area of the user's teeth are not cleaned, meaning that the efficiency of the cleaning process is reduced. The same is true for conventional oral care implements other than toothbrushes. For example, conventional tongue scrapers are able to contact and clear only a portion of the crevices and folds in the soft tissue of a user's mouth. Moreover, some users find that conventional oral care implements are uncomfortable to use.

Over the years, efforts have been made to improve the design of oral care implements, in order that they may deliver improved cleaning of users' oral cavities during oral care sessions, and are more comfortable to use. Such efforts have included the development of toothbrush heads with flexibly-mounted cleaning elements, which are better adapted to reach into the spaces between teeth and to comply with the undulating surfaces of teeth, and the development of tongue scrapers with blades or other protrusions made of soft, elastomeric material.

Despite these efforts, a need still exists for an oral care implement that has a structure that delivers improved cleaning of a user's oral cavity during use. For example, there is a need for an oral care implement that better ensures that cleaning element(s) on the head of the implement comply with oral surfaces and the complex depressions and undulations therein, in order to deliver improved cleaning of the oral surfaces. There is also a need for an oral care implement that is more comfortable for a user to use.

SUMMARY OF THE INVENTION

A first aspect of the present invention provides an oral care implement, comprising: a body having a head portion having a front side and a rear side, at least one cleaning element disposed at the front side of the head portion of the body, and a rim extending from the rear side of the head portion of the body, wherein the rim includes one or more weakened portions and extends along a perimeter region of the head portion of the body; and resilient material disposed at the rear side of the head portion of the body, wherein the rim is disposed around at least a portion of the resilient material.

Optionally, the rim and the rear side of the head portion of the body together define a basin. Optionally, at least a portion, optionally all, of the resilient material is disposed in the basin.

Optionally, at least a portion of the rim is encased in the resilient material.

Optionally, the head portion has a longitudinal axis, and weakened portions of the rim are disposed at lateral sides of the head portion.

Optionally, the head portion of the body has one or more grooves formed therein. Optionally, the, or each, groove is aligned with weakened portions of the rim disposed at opposite sides of the head portion.

Optionally, the, or each, cleaning element extends through the head portion of the body, has a distal end at the front side of head portion of the body, and has a proximal end at the rear side of the head portion of the body. Optionally, plural cleaning elements are disposed at the front side of the head portion of the body, and each of the plural cleaning elements has a distal end at the front side of the head portion of the body and a proximal end at the rear side of the head portion of the body. Optionally, the respective proximal ends of the plural cleaning elements are fused together at the rear side of the head portion of the body. The respective proximal ends of the plural cleaning elements may be fixed to the rear side of the head portion of the body.

Optionally, the resilient material contacts the proximal end of the, or each, cleaning element. The resilient material may be fixed to the proximal end of the, or each, cleaning element.

Optionally, the resilient material is fixed to the head portion of the body.

Optionally, the resilient material defines part of an exterior surface of the implement.

Optionally, a thickness of the head portion of the body measured in a direction extending between the front and rear sides of the head portion of the body is less than or equal to a thickness of the resilient material measured in the same direction.

A second aspect of the present invention provides a method of manufacturing an oral care implement, the method comprising the steps of: (a) providing a body having a head portion having a front side and a rear side; (b) providing a rim extending from the rear side of the head portion of the body, wherein the rim includes one or more weakened portions and extends along a perimeter region of the head portion of the body; (c) disposing at least one cleaning element at the front side of the head portion of the body; and (d) disposing resilient material at the rear side of the head portion of the body so that the rim is disposed around at least a portion of the resilient material.

Preferably, step (c) is carried out prior to step (d).

Optionally, the rim and the rear side of the head portion of the body together define a basin. Step (d) may comprise disposing at least a portion of the resilient material in the basin.

Optionally, the method comprises encasing at least a portion of the rim in the resilient material.

Optionally, the head portion of the body has one or more grooves formed therein. Step (b) may comprise providing the rim such that the, or each, groove is aligned with weakened portions of the rim disposed at opposite sides of the head portion.

Optionally, step (c) comprises positioning the, or each, cleaning element to extend through the head portion of the body with a distal end of the, or each, cleaning element disposed at the front side of the head portion of the body and a proximal end of the, or each, cleaning element disposed at the rear side of the head portion of the body. Optionally, step (c) comprises positioning plural cleaning elements to extend through the head portion of the body with respective distal ends of the plural cleaning elements disposed at the front side of the head portion of the body and respective proximal ends of the plural cleaning elements disposed at the rear side of the head portion of the body.

Optionally, the method comprises fusing together the respective proximal ends of the plural cleaning elements at the rear side of the head portion of the body.

Optionally, the method comprises fixing the respective proximal ends of the plural cleaning elements to the rear side of the head portion of the body.

Optionally, step (d) comprises contacting the proximal end of the, or each, cleaning element with the resilient material. Optionally, step (d) comprises fixing the resilient material to the proximal end of the, or each, cleaning element.

Optionally, the method comprises fixing the resilient material to the head portion of the body.

Optionally, the method comprises defining part of an exterior surface of the implement with the resilient material.

Optionally, in the oral care implement of the first aspect or the method of the second aspect, the rim is continuous.

Optionally, in the oral care implement of the first aspect or the method of the second aspect, the, or each, weakened portion has a cross sectional area that is less than a cross sectional area of each of two adjacent portions of the rim between which the weakened portion is disposed.

Optionally, in the oral care implement of the first aspect or the method of the second aspect, the, or each, weakened portion has a cross sectional shape that is different to a cross sectional shape of each of two adjacent portions of the rim between which the weakened portion is disposed.

Optionally, in the oral care implement of the first aspect or the method of the second aspect, the rim has varying height in a direction in which the rim extends from the rear side of the head portion of the body. The, or each, weakened portion may comprise a portion of the rim at which the height is less than the height at two adjacent portions of the rim between which the weakened portion is disposed. The, or each, weakened portion may comprise a U-shaped, V-shaped or parallel-sided notch formed in the rim, which notch extends only partially through the height of the rim.

Optionally, in the oral care implement of the first aspect or the method of the second aspect, the rim is discontinuous. The rim may comprise a plurality of walls, and the, or each, weakened portion may comprise a gap between two adjacent walls of the rim between which the weakened portion is disposed. The walls may be aligned with each other or unaligned with each other. Preferably, the walls constitute at least 80% of the rim. More preferably, the walls constitute at least 90% of the rim. Yet more preferably, the walls constitute at least 95% of the rim.

Optionally, in the oral care implement of the first aspect or the method of the second aspect, the rim extends along a perimeter of the head portion of the body.

Optionally, in the oral care implement of the first aspect or the method of the second aspect, the rim is offset from a perimeter of the head portion of the body.

Optionally, in the oral care implement of the first aspect or the method of the second aspect, the body is a unitary body.

Optionally, in the oral care implement of the first aspect or the method of the second aspect, the rim is unitary with the head portion of the body.

Optionally, in the oral care implement of the first aspect or the method of the second aspect, the head portion of the body is flexible.

Optionally, in the oral care implement of the first aspect or the method of the second aspect, the head portion of the body is formed one or more materials selected from the group consisting of: polyethylene, polypropylene, polyamide, polyester, cellulosics, styrene-acrylonitrile (SAN), acrylic, acrylonitrile butadiene styrene (ABS) and a thermoplastic.

Optionally, in the oral care implement of the first aspect or the method of the second aspect, the resilient material comprises one or more materials selected from the group consisting of: a thermoplastic elastomer (TPE) and styrene-ethylene/butylene-styrene (SEBS).

Optionally, in the oral care implement of the first aspect or the method of the second aspect, the at least one cleaning element comprises at least one tooth cleaning element. Optionally, in the oral care implement of the first aspect or the method of the second aspect, the at least one cleaning element comprises at least one tuft of bristles. Optionally, in the oral care implement of the first aspect or the method of the second aspect, the at least one cleaning element comprises at least one elastomeric element.

BRIEF DESCRIPTION OF THE DRAWINGS

A more complete understanding of the present invention, and the advantages thereof, may be acquired by referring to the following description in consideration of the accompanying drawings, in which like reference numbers indicate like features, and wherein.

DETAILED DESCRIPTION OF THE PREFERRED EMBODIMENTS

Figure 1:
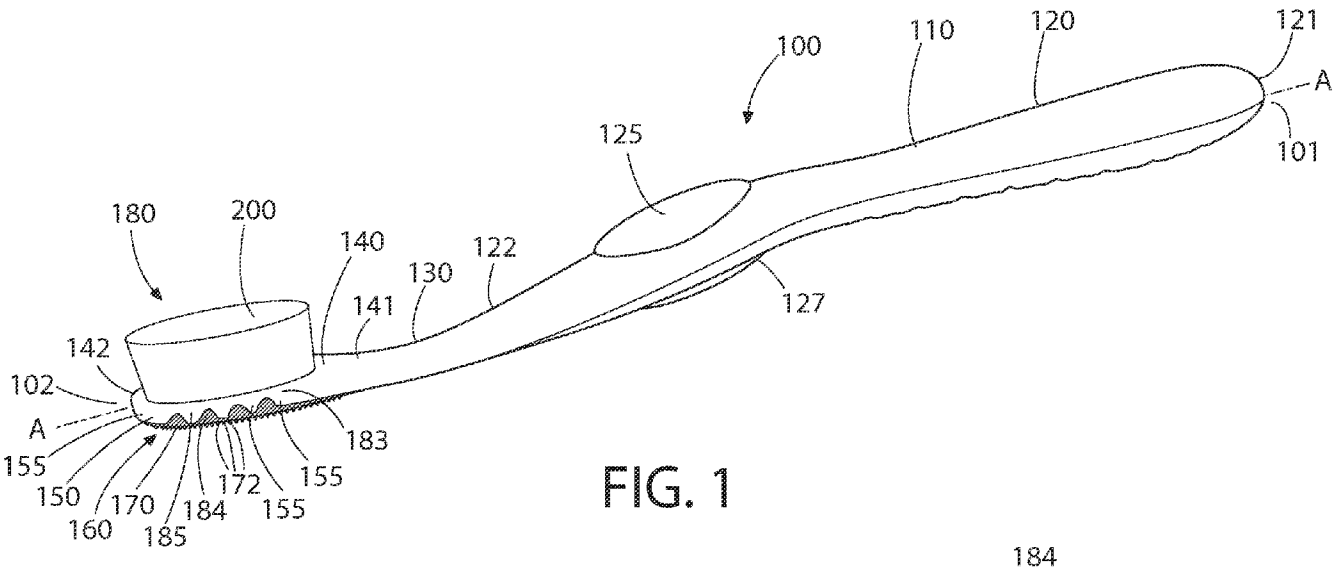
FIG. 1 is a perspective view of an oral care implement according to a first embodiment of the present invention.

The following description of the preferred embodiments is merely exemplary in nature and is in no way intended to limit the invention, its application, or uses. The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features.

In the following description, the invention is embodied in a manually-operated oral care implement, more specifically a manually-operated toothbrush. However, in other embodiments, the invention is embodied in a powered toothbrush wherein one or more cleaning elements provided to the head of the implement are drivable so as to be moved relative to the handle of the implement. In still further embodiments, the invention may be embodied in other forms of oral care implements, such as a soft-tissue cleansing implement, or another implement designed for oral care. It is to be understood that other embodiments may be utilised, and that structural and functional modifications may be made without departing from the scope of the present invention.

Figure 2:
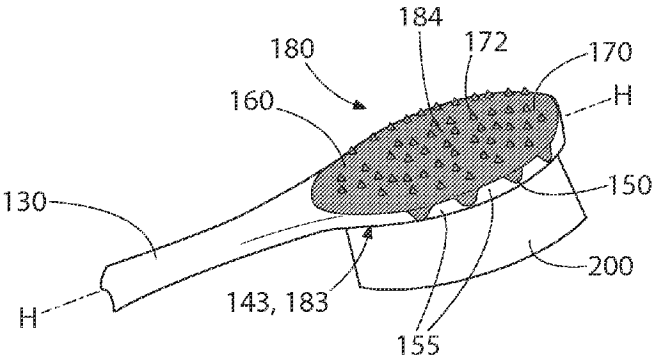
FIG. 2 is an enlarged perspective view of the head of the oral care implement of FIG. 1.

FIGS. 1 and 2 illustrate an oral care implement, in this case a toothbrush, according to a first embodiment of the present invention, generally designated with the reference numeral 100. The toothbrush 100 has a body 110 comprising a handle portion 120, a head portion 140 and a neck portion 130 that connects the handle portion 120 to the head portion 140. The head portion 140 is an end portion of the body 110 and is provided with a set 200 of cleaning elements. In FIGS. 1 and 2, the cleaning elements are illustrated as a simple block for clarity. However, it will be appreciated that, in reality, the set 200 of cleaning elements comprises a plurality of individually identifiable cleaning elements.

In this embodiment, the cleaning elements comprise a plurality of tooth cleaning elements, preferably a plurality of flexible, nylon bristles arranged in tufts. However, in variations to this embodiment, the tooth cleaning elements may additionally or alternatively comprise at least one of any one or more of the following, without limitation: bristles, rigid bristles, flexible bristles, filament bristles, fibre bristles, nylon bristles, spiral bristles, rubber bristles, elastomeric protrusions, elastomeric elements, flexible polymer protrusions, co-extruded filaments, flag bristles, crimped bristles, anti-bacterial bristles and combinations thereof and/or structures containing such materials or combinations.

The head portion 140 has a first, proximal end 141 and a second, distal end 142. The handle portion 120 has a first, proximal end 121 and a second, distal end 122. The neck portion 130 connects the distal end 122 of the handle portion 120 to the proximal end 141 of the head portion 140. The neck portion 130 is generally of a narrower cross sectional area than at least the distal end 122 of the handle portion 120 and, in some embodiments, the neck portion 130 is generally of a narrower cross sectional area than all portions of the handle portion 120.

The handle portion 120 of the body 110 provides the user with a mechanism by which he/she can readily grip and manipulate the toothbrush 100, includes ergonomic features which provide a high degree of control for the user while maintaining comfort, and may be formed of many different shapes and with a variety of constructions.

Generally, the toothbrush 100 extends from a proximal end 101 (which is also the proximal end 121 of the handle portion 120) to a distal end 102 (which is also the distal end 142 of the head portion 140) along a longitudinal axis A-A. Although the handle portion 120 is a non-linear structure in the illustrated embodiment, the longitudinal axis A-A of the implement 100 is linear in the illustrated embodiment. However, the invention is not so limited, and in certain embodiments, the implement 100 may have a simple linear handle portion 120 that is longitudinally aligned along the linear longitudinal axis A-A of the implement 100.

The head portion 140 is connected to the handle portion 120 via the neck portion 130. In this embodiment, the head portion 140, neck portion 130 and handle portion 120 are formed as an integral structure using an injection molding process. The head portion 140, handle portion 120 and neck portion 130 are together a single, unitary structure. That is, the body 110 is a unitary body. However, in other embodiments, the head portion 140 and the neck portion 130 together may be formed as a separate component from the handle portion 120, which separate components are operably connected at a later stage of the manufacturing process by any suitable technique known in the art, including without limitation thermal welding, sonic welding, a tight-fit assembly, a coupling sleeve, adhesion, fasteners, and a snap-fit connection. Whether the head and neck portions 140, 130 and the handle portion 120 are constructed as a single piece or a multi-piece assembly (including connection techniques) is not limiting of the present invention in all embodiments. Furthermore, other manufacturing techniques may be used in place of and/or in addition to injection molding to create the handle portion 120 and/or the head portion 140 (or components thereof) and/or the neck portion 130, such as milling and/or machining.

In this embodiment, the body 110 comprising each of the head portion 140, neck portion 130 and handle portion 120 is constructed of polypropylene (PP). However, in variations to this embodiment, the head portion 140 may instead or additionally be constructed of one or more of the following materials: polyethylene, polyamide, polyester, cellulosics, styrene-acrylonitrile (SAN), acrylic, acrylonitrile butadiene styrene (ABS) and a thermoplastic. In variations to this embodiment, the handle portion 120 and/or the neck portion 130 may instead or additionally be constructed of one or more of those materials. A thumb grip 125 is provided on a front side of the handle portion 120, and a rear grip 127 is provided on a rear side of the handle portion 120 opposite to the front side of the handle portion 120. The thumb and rear grips 125, 127 are non-unitary with the body 110, and may be formed of any of the materials discussed below for the resilient material 160.

The head portion 140 generally comprises a front surface, on a front side 143 of the head portion 140, and a rear surface, on a rear side 144 of the head portion 140 opposite to the front side 143. The front surface and the rear surface of the head portion 140 can take on a wide variety of shapes and contours, none of which are limiting of the present invention. For example, the front and rear surfaces can be planar, contoured or combinations thereof. The cleaning elements are provided on, and extend outward from, the front side 143 of the head portion 140 for cleaning contact with an oral surface, preferably teeth. A rim 150 extends from the rear side 144 of the head portion 140, and resilient material 160 is disposed at the rear side 144 of the head portion 140, as will be described in more detail below. Together, the head portion 140, the rim 150, the resilient material 160, and the set 200 of cleaning elements define a head 180 of the implement 100. The cleaning elements are provided on, and extend outward from, a front side 183 of the head 180, which is defined by the front side 143 of the head portion 140.

While the set 200 of plural cleaning elements are particularly suited for cleaning teeth, the cleaning elements can be used to clean oral soft tissue, such as a tongue, gums, or cheeks instead of or in addition to teeth. As used herein, the term "cleaning element" is used in a generic sense to refer to any structure that can be used to clean, massage or polish an oral surface, such as teeth or soft tissue, through relative surface contact.

Indeed, in a variation to the embodiment shown in FIGS. 1 and 2, instead of a set 200 of tooth cleaning elements, there is instead provided at least one soft tissue cleaning element, such as a tongue scraper comprising at least one blade. Preferably, the, or each, blade has its longitudinal length disposed so as to extend laterally across the front side 183 of the head 180. The at least one soft tissue cleaning element may have one or more proximal ends that are connected to the rest of the head in substantially the same manner as the proximal ends of the plurality of tooth cleaning elements discussed below for the first embodiment.

On a rear side 184 of the head 180 is disposed a soft tissue cleaner 170 formed from the resilient material 160. The soft tissue cleaner 170 comprises a plurality of flexible protrusions 172. Preferably, the protrusions 172 and the rest of the soft tissue cleaner 170 are a unitary component. Preferably the soft tissue cleaner 170 and the protrusions 172 are made of an elastomer, such as a thermoplastic elastomer (TPE), or styrene-ethylene/butylene-styrene (SEBS). The front side 183 and rear side 184 of the head 180 are joined by a peripheral or lateral side 185 of the head 180.

Manufacture of the oral care implement 100 shown in FIGS. 1 and 2, and particularly of the head 180 of the oral care implement 100, will now be described with additional reference to FIGS. 3 to 5.

First, a unitary body 110 having a head portion 140 having a front side 143 and a rear side 144 is provided. A rim 150 extends from the rear side 144 of the head portion 140 of the body 110. The rim 150 is unitary with the head portion 140 of the body 110. The head portion 140 and the rim 150 are formed together by molding (e.g. injection molding) polypropylene (PP) in a suitably shaped mold. As discussed above, in this embodiment the head portion 140 is unitary with the neck portion 130 and the handle portion 120 of the implement 100. Accordingly, the rim 150 is unitary with the head portion 140, the neck portion 130, and the handle portion 120 of the body 110 of the implement 100. That is, all of the rim 150, head portion 140, neck portion 130 and handle portion 120 are molded from PP in a mold. A proximal end 141 of the head portion 140 connects the head portion 140 to the neck portion 130, and a distal end 142 of the head portion 140 is disposed distal from the neck portion 130.

Note that, although PP is used in this embodiment, in variations to this embodiment, the body 110 may instead or additionally be constructed of (e.g. molded of) one or more of the following materials: polyethylene, polyamide, polyester, cellulosics, styrene-acrylonitrile (SAN), acrylic, acrylonitrile butadiene styrene (ABS) and a thermoplastic. Preferably the head portion 140 of the body 110 is formed of a flexible material, or at least a material that is flexible when forming a sufficiently thin component, such as the head portion 140 of the body 110.

Figure 3:
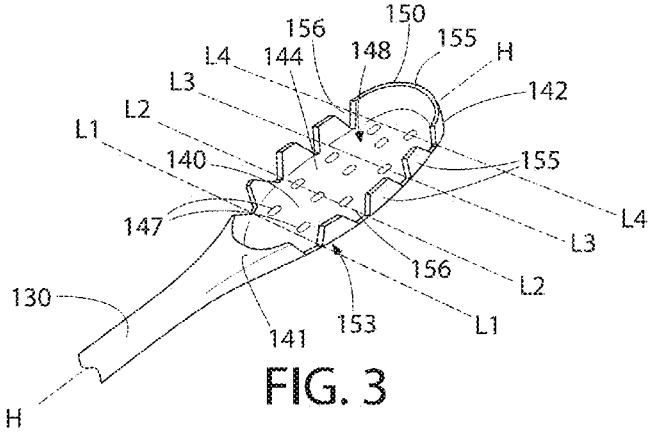
FIG. 3 is an enlarged perspective view of the rear side of the head portion of the head of FIG. 2 prior to insertion of cleaning elements during manufacture of the implement.

As will be noted from FIG. 3, the head portion 140 of the body 110 is a plate and is provided with a plurality of holes 147 that extend between its front and rear sides 143, 144. In this embodiment, the head portion 140 of the body 110 (and ultimately the completed head 180) has a longitudinal axis H-H extending between its proximal and distal ends 141, 142, which axis H-H may be parallel to, or the same as, the longitudinal axis A-A of the implement 100. In this embodiment, the axis H-H lies in the same plane as the axis A-A.

The rim 150 extends along a perimeter region of the head portion 140 of the body 110 and includes a plurality of weakened portions 156. The weakened portions 156 are portions of the rim 150 that are weaker than stronger portions of the rim 150 adjacent the weakened portions 156, between which stronger portions the weakened portions 156 are disposed. Thus, the weakened portions 156 permit flexing of the rim 150 and the head portion 140. While in this embodiment the rim 150 extends along a perimeter of the head portion 140, in a variation to this embodiment the rim 150 extends along the perimeter region of the head portion 140 but is offset from the perimeter of the head portion 140.

In this embodiment, the rim 150 comprises a plurality of walls 155 and each of the weakened portions is a V-shaped gap or space 156 between two adjacent walls 155 of the rim 150 between which the weakened portion 156 is disposed. Accordingly, the rim 150 is a discontinuous rim. The walls 155 are aligned with each other on an elliptical path. In a variation to this embodiment, the walls 155 may be unaligned with each other, or staggered, such that one or more of the walls 155 does not lie on the same, e.g. elliptical, path as one or more other of the walls 155.

Each gap 156 has an apex proximal the head portion 140 and an open end distal from the head portion 140. In this embodiment, the gaps 156 of the rim 150 are disposed at lateral sides of the head portion 140 relative to the axis H-H. Gaps 156 of the rim 150 are not provided at the proximal or distal ends 141, 142 of the head portion 140 of the body 110 although, in variations to this embodiment, the rim 150 may comprise gaps 156 at the proximal end 141 and/or the distal end 142 of the head portion 140 of the body 110. Each of the gaps 156 at one lateral side of the head portion 140 is aligned with a gap 156 at the other lateral side of the head portion 140, so that the apexes of two laterally-opposed gaps 156 lie on a lateral axis L1-L1, L2-L2, L3-L3, L4-L4 of the head portion 140 of the body 110. Due in part to the thin nature of the head portion 140, and in part to the provision of the gaps 156 at one lateral side of the head portion 140 being aligned with the gaps 156 at the other lateral side of the head portion 140, the head portion 140 is permitted to flex about any of the lateral axes L1-L1, L2-L2, L3-L3, L4-L4, of the head portion 140. Together, the rim 150 and the rear side 144 of the head portion 140 define a basin 148, albeit with discontinuous sides.

Figure 4:
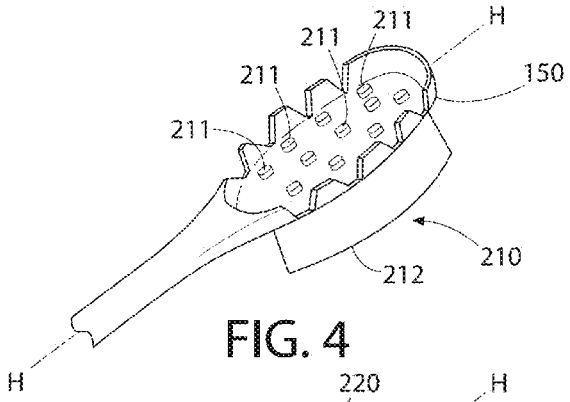
FIG. 4 is an enlarged perspective view of the rear side of the head portion of the head of FIG. 3 after insertion of plural cleaning elements during manufacture of the implement.
Figure 5:
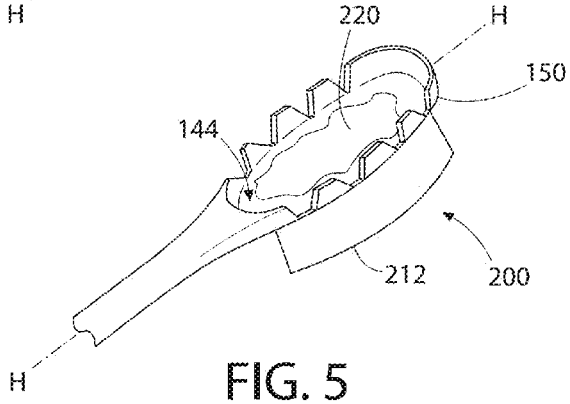
FIG. 5 is an enlarged perspective view of the rear side of the head portion of the head of FIG. 4 after proximal ends of the plural cleaning elements have been fused together during manufacture of the implement.

Next, and with reference to FIG. 4, plural tooth cleaning elements 210 are disposed at the front side 143 of the head portion 140 of the body 110. In the completed implement 100, the tooth cleaning elements 210 together comprise the set 200 of cleaning elements. Each tooth cleaning element 210 is a bristle with a proximal end 211 and a distal end 212 and, more specifically, each tooth cleaning element 210 is positioned so that it extends through one of the holes 147 in the head portion 140 of the body 110, so that its distal end 212 is disposed at the front side 143 of the head portion 140 and its proximal end 211 is disposed at the rear side 144 of the head portion 140. Plural of the tooth cleaning elements 210 extend through each of the holes 147 and together form a tuft of bristles.

Preferably the bristles are formed of nylon. However, they may additionally or instead be formed of one or more of; acryl, PP, polyester, polyethylene terephthalate (PET), and polybuthylene terephthalate (PBT).

In variations to this embodiment, one or some of the tooth cleaning elements 210 comprises an elastomeric tooth cleaning element. In such variations, the elastomeric tooth cleaning element(s) may be formed on the front side 143 of the head portion 140, or may extend through the holes 147 in the head portion 140 in a similar manner to the above-described bristles.

The tooth cleaning elements 210 may be disposed through the holes 147 in any manner. Preferably, the head portion 140 of the body 110 (along with the neck portion 130 and the handle portion 120) is held in a jig, and picks (i.e. clusters) of the cleaning elements 210 are pushed into holes in a holder (not shown) by a pusher. The cleaning elements 210 are subsequently transferred from the holder to the holes 147 in the head portion 140 of the body 110 by pushing the cleaning elements 210 by the same, or a different, pusher. The cleaning elements 210 preferably are inserted through the holes 147 from the rear side 144 of the head portion 140, so that the distal ends 212 of the cleaning elements 210 pass through the holes 147 and are then brought into contact with a former (not shown) that has a profile matching the desired final profile of the brushing surface of the cleaning elements 210 in the completed implement 100. For example, if it is desired for the distal ends 212 of the cleaning elements 210 to all lie substantially in the same plane, then the profile of the former would be flat or substantially flat. Other possible profiles will be apparent to the person skilled in the art.

Preferably, the cleaning elements 210 in each of the picks are pre-cut to a desired final length and/or any shaping of the distal ends 212 of the cleaning elements 210, such as tapering, is carried out before insertion of the cleaning elements 210 into the holes 157.

Once the distal ends 212 of the cleaning elements 210 are in contact with the former, the cleaning elements 210 are held in place relative to the head portion 140 with the proximal ends 211 of the cleaning elements 210 exposed at, and extending from, the rear side 144 of the head portion 140. The respective proximal ends 211 are then fused together (e.g. by melting the proximal ends 211) at the rear side 144 of the head portion 140. Specifically, the proximal ends 211 of cleaning elements 210 extending through the same hole 147 are fused together, and also the proximal ends 211 of all the cleaning elements 210 are fused together at the rear side 144 of the head portion 140, to form a mass 220 of material, or melt matte, as shown in FIG. 5. Flow of the material of the melt matte 220 is restricted by the walls 155, to avoid or minimise contact of the material with the jig in which the head portion 140 is held. This formation of the melt matte 220 acts to restrict or prevent the cleaning elements 210 being able to be pulled from out of the holes 147.

In this embodiment, the walls 155 constitute approximately 90% of the rim 150, the gaps 156 making up the remainder of the rim 150. In other embodiments, the walls may constitute more, e.g. 95%, or less, e.g. 80 or 85%, of the rim 150. The greater the proportion of the rim 150 formed by the walls 155, the better flow of the material of the melt matte 220 is restricted by the rim 150.

Preferably the proximal ends 211 of the cleaning elements 210, i.e. the melt matte 220, are fixed to the rear side 144 of the head portion 140 so that the cleaning elements 210 are fixed to the body 110. This fixing further acts to restrict or prevent the cleaning elements 210 being able to be pulled from out of the holes 147. Depending on the materials from which the head portion 140 and cleaning elements 210 are formed, this fixing may occur automatically as the proximal ends 211 of the cleaning elements 210 are fused to one another. However, in some cases, the proximal ends 211 of the cleaning elements 210 may be fixed to the rear side 144 of the head portion 140 by other means, such as by adhesion using an adhesive.

Next, resilient material 160 is disposed at the rear side 144 of the head portion 140 of the body 110. Specifically, the resilient material 160 is disposed at the rear side 144 of the head portion 140 in such a manner that the rim 150 remains disposed around a portion of the resilient material 160. In this embodiment, the resilient material 160 comprises a thermoplastic elastomer (TPE). In a variation to this embodiment, the resilient material 160 may instead or additionally comprise styrene-ethylene/butylene-styrene (SEBS).

Preferably, the resilient material 160 is injected in a melted state into the basin 148, most preferably to fill the basin 148, and subsequently allowed to cool to form a flexible cover. In this embodiment, the resilient material 160 also fills the gaps 156 between the walls 155, but leaves the exterior sides of the walls 155 uncovered to form part of the lateral side 185 of the head 180. However, in a variation to this embodiment, the resilient material 160 does not fill the gaps 156 between the walls 155, and the rim 150 is disposed around all of the resilient material 160. In further variations to the described embodiments, the resilient material 160 encases at least a portion of the rim 150, e.g. at least a portion of the walls 155. The extent of flow of the resilient material 160 is controlled by the walls 155 and by placing the combination of the head portion 140 and cleaning elements 210 (shown in FIG. 5) in a suitably shaped mold.

Preferably the resilient material 160 is fixed to the proximal ends 211 of the cleaning elements 210, i.e. the melt matte 220. Depending on the materials of the cleaning elements 210 and the resilient material 160, this fixing may occur automatically as the resilient material 160 is injected into the basin 148 and subsequently allowed to cool while contacting the proximal ends 211 of the cleaning elements 210. However, in some cases, an adhesive may be provided on the proximal ends 211 of the cleaning elements 210, to cause the subsequently-injected resilient material 160 to become fixed to the proximal ends 211 of the cleaning elements 210 by adhesion.

Alternatively or additionally, the resilient material 160 may be fixed to the head portion 140, preferably to the rear side 144 of the head portion 140, and/or to the basin-facing sides of the walls 155. Depending on the materials of the head portion 140 and/or the walls 155 and the resilient material 160, this fixing may occur automatically as the resilient material 160 is injected into the basin 148 and subsequently allowed to cool while contacting the head portion 140 and/or the walls 155. However, in some cases, an adhesive may be provided on portions of the head portion 140 and/or walls 155, to cause the subsequently-injected resilient material 160 to become fixed to the head portion 140 and/or walls 155 by adhesion.

In further variations to each of these described embodiments, the resilient material 160 is not injected in a melted state into the basin 148, but instead is a pre-formed flexible cover. The cover may be fixed to any one, two or all of the head portion 140, the walls 155 and the proximal ends 211 of the cleaning elements 210, for example by adhesion using a suitable adhesive.

The disposing of the resilient material 160 at the rear side 144 of the head portion 140 comprises contacting and covering all the proximal ends 211 of the cleaning elements 210, i.e. the melt matte 220, with the resilient material 160. Moreover, the disposing of the resilient material 160 at the rear side 144 of the head portion 140 comprises covering the rear side 144 of the head portion 140 with the resilient material 160.

The resilient material 160, once cooled and hardened (although still resilient), forms the soft tissue cleaner 170 comprising the plurality of flexible protrusions 172 on the rear side 184 of the head 180. However, in some embodiments such as the second embodiment discussed below, no protrusions 172 are provided on the rear side 184 of the head 180. That is, no soft tissue cleaner 170 is provided. In such embodiments, the resilient material 160 preferably has a smooth, or substantially smooth, surface. In any event, preferably the resilient material 160 defines part of an exterior surface of the head 180 of the implement 100.

The rear side 144 of the head portion 140 is concealed in the finished head 180 by the resilient material 160, while the front side 143 of the head portion 140 is exposed and forms the front side 183 of the head 180 of the implement 100, from which front side 183 the cleaning elements 210 extend.

In variations to the above-described embodiments, the head portion 140 has one or more, preferably transverse or laterally-extending, grooves (not shown) formed therein. The groove(s) may be formed in the front side 143 and/or the rear side 144 of the head portion 140. Most preferably, the, or each, groove is aligned with weakened portions, in this embodiment gaps 156, disposed at opposite sides of the head portion 140. Preferably the, or each, groove is aligned with a pair of laterally-opposed weakened portions, e.g. gaps 156. These groove(s) form portion(s) of the head portion 140 that have a reduced thickness between the front and rear sides 143, 144 of the head portion 140, and thus form living hinges in the head portion 140. Accordingly, the head portion 140 is better able to flex about one or more, preferably lateral, axes of the head portion 140. Moreover, when these groove(s) are provided, the head portion 140 may be formed of a material that is substantially rigid at portions of the head portion 140 away from the groove(s), yet flexible at the portion(s) of the head portion 140 that have the reduced thickness between the front and rear sides 143, 144 of the head portion 140.

In the above-described embodiment, the resilient material 160 occupies at least 70% of a combined volume of the resilient material 160 and the head portion 140 of the body 110. In variations to this embodiment, the resilient material 160 occupies at least 60% or at least 50% of the combined volume of the resilient material 160 and the head portion 140. In some embodiments, the resilient material 160 occupies less than 50% of a combined volume of the resilient material 160 and the head portion 140.

Moreover, in the above-described embodiment, a thickness of the head portion 140, measured over the shortest distance between the front and rear sides 143, 144 of the head portion 140 and inward of the rim 150, is less than the thickness of the resilient material 160 measured in the same direction. In this embodiment, the thickness of the head portion 140 is approximately 20% of the thickness of the resilient material 160 measured in the same direction. In variations to this embodiment, this figure may be less than 50%, less than 40%, less than 30%, or less than 10%. Preferably, the thickness of the head 180 measured in this direction is formed only of the resilient material 160 and the head portion 140.

However, it will be appreciated that, preferably, the majority of the volume of the combination of the head portion 140 and resilient material 160, and the majority of the thickness of the head 180 measured as described above, is made up of the resilient material 160. This affords the head 180 with a high degree of flexibility, particularly when the head portion 140 is formed of a flexible material.

Moreover, the greater the proportion of the rim 150 formed by the walls 155, the more robust the finished head 180. The lower the proportion of the rim 150 formed by the walls 155, the more flexible the finished head 180.

Figure 6:
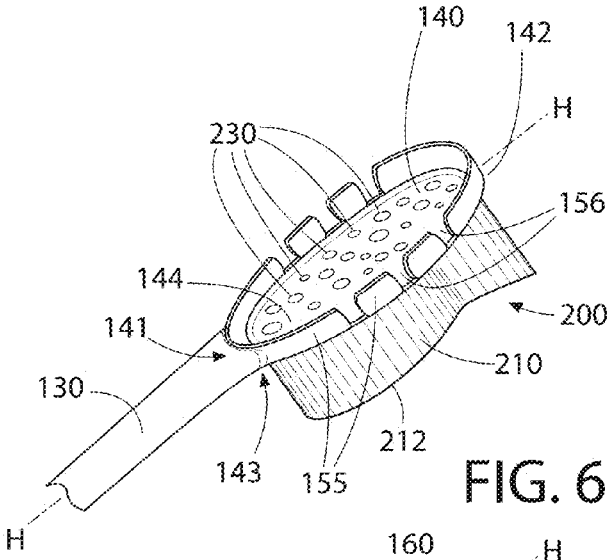
FIG. 6 is an enlarged perspective view of the rear side of the head portion of the head of an oral care implement according to a second embodiment of the present invention after proximal ends of plural cleaning elements have been fused together during manufacture of the implement.
Figure 7:
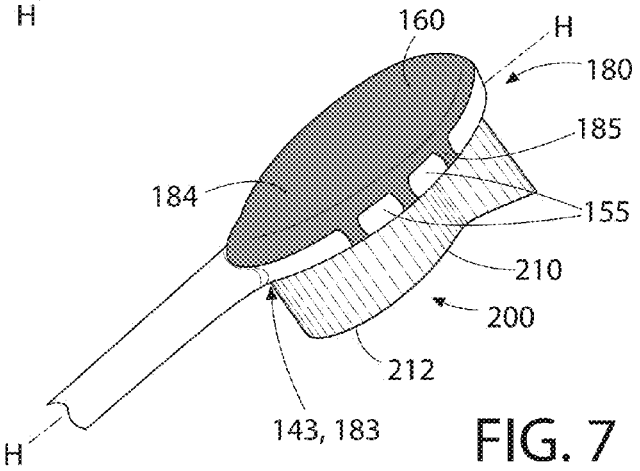
FIG. 7 is an enlarged perspective view of the head of FIG. 6 in a complete and unflexed state.
Figure 8:
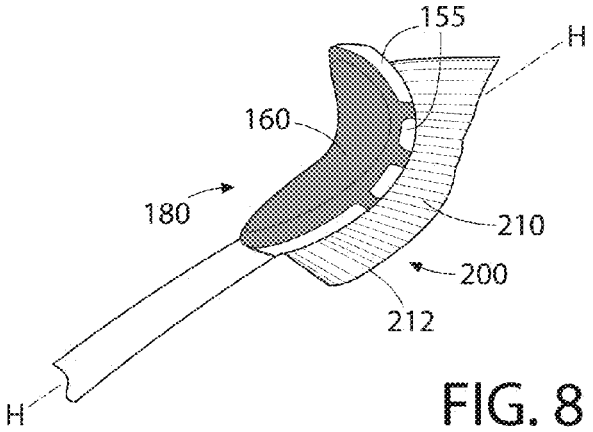
FIG. 8 is an enlarged perspective view of the head of FIG. 7 showing the head in a flexed state.

A second embodiment of the present invention will now be described with reference to FIGS. 6 to 8. Like elements shown in FIGS. 1 to 5 are indicated in FIGS. 6 to 8 with the same reference numerals. In the interests of conciseness, the elements common to the two embodiments will not be described in detail again with reference to FIGS. 6 to 8. All of the above-described possible variations to the first embodiment are equally applicable to the second embodiment.

Whereas in the first embodiment the resilient material 160 forms a soft tissue cleaner 170 comprising the plurality of flexible protrusions 172 on the rear side 184 of the head 180 of the implement 100, in the second embodiment no protrusions 172 are provided on the rear side 184 of the head 180. That is, no soft tissue cleaner 170 is provided. Rather, the resilient material 160 has a smooth, or substantially smooth, surface that forms the rear side 184 of the head 180.

Whereas in the first embodiment the walls 155 are spaced apart by V-shaped gaps or spaces 156, in the second embodiment the walls are spaced apart by square-shaped or rectangular-shaped gaps or spaces 156. In variations to each embodiment, the gaps or spaces 156 may have different shapes. Indeed, in some embodiments, some of the gaps or spaces 156 may be of a different shape to others of the gaps or spaces 156.

Whereas in the first embodiment the distal ends 212 of the cleaning elements 210 all lie substantially in the same plane, in the second embodiment distal ends 212 of cleaning elements 210 at the distal end 142 of the head portion 140 are disposed further from the front side 143 of the head portion 140 than distal ends 212 of cleaning elements 210 at the proximal end 141 of the head portion 140. The cleaning elements 210 at the distal end 142 of the head portion 140 are better suited to reach spaces between a user's teeth.

Also, whereas in the first embodiment the proximal ends 211 of all the cleaning elements 210 are fused together at the rear side 144 of the head portion 140 to form a melt matte 220, in the second embodiment only the proximal ends 211 of cleaning elements 210 that extend through the same hole 147 are fused together, to form individual spaced apart masses 230 of material of the cleaning elements 210. That is, after fusing, the proximal ends 211 of cleaning elements 210 that extend through one of the holes 147 are not fused to proximal ends 211 of cleaning elements 210 that extend through another one of the holes 147. In comparison to the first embodiment, this leaves exposed a greater area of the rear face 144 of the head portion 140 for the resilient material 160 to contact and be fixed to.

FIG. 7 shows the head portion 140, and indeed completed head 180, of the second embodiment in an unflexed state, while FIG. 8 shows the head portion 140 and head 180 of the second embodiment in a flexed state. The resilient material 160 at the rear side 144 of the head portion 140 and in the gaps 156 is compressible, to allow the gaps 156 to reduce in size and the walls 155 to approach each other as the head 180 is flexed. Similar degrees of flex are attainable with the head portion 140 and head 180 of the first embodiment. It will be appreciated that this flexibility of the head portion 140 and head 180 better ensures that elements 210 on the head 180 of the implement 100 are able to comply with oral surfaces and the complex depressions and undulations therein, in order to deliver improved cleaning of the oral surfaces. The flexibility also makes the oral care implement more comfortable for a user to use.

While in the above-described embodiments the head portion 140 and head 180 are flexible about an axis or axes that is/are perpendicular to the longitudinal axis H-H of the head portion 140 and the longitudinal axis A-A of the implement 100, in other embodiments the gaps 156 between walls 155 and/or groove(s) are disposed to permit the head portion 140 and head 180 to flex additionally or alternatively about another axis or axes, such as an axis or axes this is/are parallel to the longitudinal axis H-H of the head portion 140 and the longitudinal axis A-A of the implement 100.

In each of the above-described embodiments, the rim 150 comprises wall(s) 155 and gap(s) 156, and thus is discontinuous. In variations to the above-described embodiments, the gaps 156 fully through the height of the rim 150 may be omitted, so that the rim is continuous. The, or each, weakened portion 156 of the rim 150 may have a cross sectional shape and/or area that is different to a cross sectional shape and/or area of each of two adjacent portions of the rim 150 between which the weakened portion 156 is disposed. The rim 150 may have varying height in a direction in which the rim 150 extends from the rear side 144 of the head portion 140. For example, the, or each, weakened portion 156 may comprise a portion of the rim 150 at which the height is less than the height at two adjacent portions of the rim 150 between which the weakened portion 156 is disposed. The, or each, weakened portion 156 may comprise a notch, such as a U-shaped, V-shaped or parallel-sided notch, formed in the rim 150, which notch extends only partially through the height of the rim 150. Thus, such notch(es) may be similar to the gaps 156 shown in FIGS. 3 to 5, but extending only partially through the height of the rim 150 so that material of the rim 150 exists between the notch(es) and the head portion 140. Alternatively or additionally, the, or each, weakened portion 156 may comprise a portion of the rim 150 at which a thickness of the rim 150 (perpendicular to the direction in which the rim 150 extends from the rear side 144 of the head portion 140) is less than the thickness at two adjacent portions of the rim 150 between which the weakened portion 156 is disposed. Preferably, the rim 150 includes material along the full extent of the rim 150.

In each of the above-described embodiments, the head portion 140 is unitary with the neck portion 130 and the handle portion 120 of the implement 100. In variations to the above-described embodiments, the head portion 140 may not be unitary with the neck portion 130 and/or the handle portion 120 of the implement 100. In such embodiments, preferably the front side 143 of the head portion 140 still forms the front side 183 of the head 180, but the head 180 is connectable, e.g. removably connectable, to a handle portion 120 via a neck portion 130. The neck portion 130 may be unitary with the handle portion 120 or with the head portion 140.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the scope of the invention should be construed broadly as set forth in the appended claims.

What is claimed is:

1. An oral care implement, comprising:

a body having a head portion having a front side and a rear side, at least one cleaning element disposed at the front side of the head portion of the body, and a rim extending from the rear side of the head portion of the body and terminating at a distal end, wherein the rim includes one or more weakened portions and extends along a perimeter region of the head portion of the body; and resilient material disposed at the rear side of the head portion of the body, wherein the rim is disposed around at least a portion of the resilient material, the resilient material filling the one or more weakened portions and covering an entirety of the distal end of the rim.

2. The oral care implement of claim 1, wherein the rim and the rear side of the head portion of the body together define a basin.

3. The oral care implement of claim 2, wherein at least a portion of the resilient material is disposed in the basin.

4. The oral care implement of claim 1, wherein the head portion has a longitudinal axis, and wherein weakened portions of the rim are disposed at lateral sides of the head portion.

5. The oral care implement of claim 1, wherein the head portion of the body has one or more grooves formed therein.

6. The oral care implement of claim 5, wherein the, or each, groove is aligned with weakened portions of the rim disposed at opposite sides of the head portion.

7. The oral care implement of claim 1, wherein the, or each, cleaning element extends through the head portion of the body, has a distal end at the front side of head portion of the body, and has a proximal end at the rear side of the head portion of the body.

8. The oral care implement of claim 7, wherein plural cleaning elements are disposed at the front side of the head portion of the body, and wherein each of the plural cleaning elements has a distal end at the front side of the head portion of the body and a proximal end at the rear side of the head portion of the body.

9. The oral care implement of claim 8, wherein the respective proximal ends of the plural cleaning elements are fused together at the rear side of the head portion of the body.

10. The oral care implement of claim 8, wherein the respective proximal ends of the plural cleaning elements are fixed to the rear side of the head portion of the body.

11. The oral care implement of claim 7, wherein the resilient material contacts the proximal end of the, or each, cleaning element.

12. The oral care implement of claim 11, wherein the resilient material is fixed to the proximal end of the, or each, cleaning element.

13. The oral care implement of claim 1, wherein the resilient material is fixed to the head portion of the body.

14. The oral care implement of claim 1, wherein the resilient material defines part of an exterior surface of the implement.

15. The oral care implement of claim 1, wherein a thickness of the head portion of the body measured in a direction extending between the front and rear sides of the head portion of the body is less than or equal to a thickness of the resilient material measured in the same direction.

16. The oral care implement of claim 1, wherein the, or each, weakened portion has a cross sectional area that is less than a cross sectional area of each of two adjacent portions of the rim between which the weakened portion is disposed.

17. The oral care implement of claim 1, wherein the rim has varying height in a direction in which the rim extends from the rear side of the head portion of the body.

18. The oral care implement of claim 1, wherein the rim is discontinuous.

19. The oral care implement of claim 1, wherein the rim extends along a perimeter of the head portion of the body.

20. The oral care implement of claim 1, wherein the rim is offset from a perimeter of the head portion of the body.

21. The oral care implement of claim 1, wherein the rim is unitary with the head portion of the body.

22. The oral care implement of claim 1, wherein the head portion of the body is flexible.

23. An oral care implement, comprising:

a body having a head portion having a front side and a rear side, at least one cleaning element disposed at the front side of the head portion of the body, and a rim extending from the rear side of the head portion of the body and terminating at a distal end, wherein the rim includes one or more weakened portions and extends along a perimeter region of the head portion of the body; and wherein the rim and the rear side of the head portion of the body together define a basin, the rear side of the head forming a floor of the basin;

resilient material disposed at the rear side of the head portion of the body, at least a portion of the resilient material disposed in the basin, wherein the rim is disposed around at least a portion of the resilient material; and wherein the one or more weakened portions comprises a gap formed into the rim that extends from the distal end of the rim and terminates at the floor of the basin.

24. An oral care implement, comprising:

a body having a head portion having a front side and a rear side, at least one cleaning element disposed at the front side of the head portion of the body, and a rim extending from the rear side of the head portion of the body, wherein the rim includes one or more weakened portions and extends along a perimeter region of the head portion of the body; and resilient material disposed at the rear side of the head portion of the body, wherein the rim is disposed around at least a portion of the resilient material;

wherein the rim has a substantially constant thickness from the rear side of the head portion of the body to a distal end of the rim.

* * * * *